US008089828B2

(12) United States Patent
Fischer et al.

(10) Patent No.: US 8,089,828 B2
(45) Date of Patent: Jan. 3, 2012

(54) ACOUSTIC SENSOR ELEMENT

(75) Inventors: Frank Fischer, Gomaringen (DE); Arnim Hoechst, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 254 days.

(21) Appl. No.: 12/598,994

(22) PCT Filed: Jun. 10, 2008

(86) PCT No.: PCT/EP2008/057211

§ 371 (c)(1),
(2), (4) Date: Nov. 5, 2009

(87) PCT Pub. No.: WO2009/000641

PCT Pub. Date: Dec. 31, 2008

(65) Prior Publication Data

US 2010/0135123 A1 Jun. 3, 2010

(30) Foreign Application Priority Data

Jun. 28, 2007 (DE) ..... 10 2007 029 911

(51) Int. Cl.
*H04R 19/04* (2006.01)

(52) U.S. Cl. ..... 367/181

(58) Field of Classification Search ..... 367/181
See application file for complete search history.

(56) References Cited

U.S. PATENT DOCUMENTS

| | | | | |
|---|---|---|---|---|
| 6,535,460 | B2 | 3/2003 | Loeppert et al. | |
| 7,243,551 | B2 * | 7/2007 | Fischer et al. | 73/754 |
| 2002/0067663 | A1 | 6/2002 | Loeppert et al. | |
| 2005/0193827 | A1 * | 9/2005 | Fischer et al. | 73/754 |
| 2006/0093170 | A1 | 5/2006 | Zhe et al. | |
| 2007/0047746 | A1 | 3/2007 | Weigold et al. | |
| 2007/0058825 | A1 | 3/2007 | Suzuki et al. | |
| 2010/0135123 | A1 * | 6/2010 | Fischer et al. | 367/181 |

FOREIGN PATENT DOCUMENTS

| | | | |
|---|---|---|---|
| DE | 102007029911 | A1 * | 1/2009 |
| WO | WO 2009000641 | A1 * | 12/2008 |

OTHER PUBLICATIONS

International Search Report, PCT International Patent Application No. PCT/EP2008/057211, dated Sep. 8, 2008.

* cited by examiner

*Primary Examiner* — Daniel Pihulic
(74) *Attorney, Agent, or Firm* — Kenyon & Kenyon LLP

(57) ABSTRACT

A micromechanical acoustic sensor element, which has at least one diaphragm and at least one fixed counter element, the diaphragm being situated in a cavity between a substrate and the counter element and acting as movable electrode of a capacitor system, the counter element acting as first fixed counter electrode of this capacitor system, and at least one through hole being formed in the substrate for the application of sound pressure to the diaphragm. For fixation and strengthening purposes, the counter element is connected to the substrate via at least one support element. The support element is situated in the region of the cavity, and an opening is formed in the diaphragm for the support element.

7 Claims, 5 Drawing Sheets

ACOUSTIC SENSOR ELEMENT

FIELD OF THE INVENTION

The present invention relates to an acoustic sensor element having at least one diaphragm and at least one fixed counter element. The diaphragm of the sensor element is situated in a cavity between a substrate and the counter element and acts as movable electrode of a capacitor system, while the counter element functions as fixed counter electrode of this capacitor system. At least one through hole is formed in the substrate, via which sound pressure is able to act upon the diaphragm.

BACKGROUND INFORMATION

Micromechanical microphones are available which convert the sound waves into an electrical signal with the aid of such a sensor element. The conventional sensor elements include a capacitor system having at least two electrodes, between which an air gap of 0.5 μm to 10 μm is situated. Ideally, one electrode is rigid while the other electrode is movable, so that it is induced to oscillate when sound waves arrive. This causes a change in the capacitance between the two electrodes in accordance with the varying sound pressure.

The quality of such a micromechanical transducer element generally depends on the immovability of the counter electrode. In practice, the counter electrode is therefore frequently provided with relatively great thickness in that it is either structured out of the carrier substrate of the transducer element, or in that it is retroactively provided with a thick layer made of epi polysilicon, for example. However, high rigidity of the counter electrode may also be achieved if the counter electrode is produced under high tensile stress. Both the structuring of the carrier substrate and the producing of high layer thicknesses or the producing of highly stretched layers is labor-intensive and correspondingly costly.

An acoustic sensor or transducer element is described in U.S. Pat. No. 6,535,460 B2. The design of this sensor element includes a substrate having a through hole, which is spanned by a diaphragm. A perforated counter element is situated above the diaphragm, at a distance therefrom, and is connected to the substrate in the edge region of the through hole. Diaphragm and counter element jointly form a capacitor, the diaphragm acting as movable electrode while the counter element constitutes the rigid electrode. Via the through hole in the substrate, sound waves are acting upon the diaphragm, which causes the diaphragm to oscillate. The movement of the diaphragm is then detected with the aid of the counter element as capacity fluctuations of the capacitor. Special measures for affixing and/or strengthening the perforated counter element are not described in U.S. Pat. No. 6,535,460 B2.

SUMMARY

The present invention provides simple constructive measures for improving the transducer characteristics of a micromechanical acoustic sensor element of the type mentioned in the introduction. These measures concern the fixation and strengthening of the counter element or the counter electrode of the capacitor system, in particular.

According to example embodiments of the present invention, the counter element is connected to the substrate by at least one support element for this purpose, the support element being situated in the region of the cavity. Moreover, an opening is formed in the diaphragm for the support element, so that the diaphragm is able to swing freely within the cavity.

According to the present invention it was realized that the rigidity of the counter element is able to be increased simply in that the counter element is supported at one or a plurality of locations on an existing firm structure of the substrate, and the wing span of the counter element is therefore reduced. This measure provides the opportunity to realize the counter element also in the form of a thin layer that need not necessarily be under tensile stress. The wing span of the diaphragm, and thus also the sensitivity of the sensor element, are not affected by the support element to any important extent since the diaphragm according to the present invention is provided with openings through which the support elements extend from the counter element to the substrate structure, so that the diaphragm is able to move freely between the counter element and the substrate structure.

Because the counter element of the example sensor element according to the present invention is able to be realized in a thin layer, which need not be designed for high tensile stressing, overall the example sensor element according to the present invention may be produced with the aid of standard semiconductor processes, which are cost-effective and allow high volume production.

There are basically different possibilities for designing a sensor element according to the present invention and, in particular, for the placement of the support elements in the region of the cavity between the counter element and the substrate.

In one preferred variant of the present invention, a substrate structure having a substrate base for the support element is formed in the area below the cavity. Therefore, the substrate base is situated underneath the cavity and thus connected to the "substrate mainland", so that the substrate base is fixed in place and forms an excellent support point for the support element and the counter element.

In an advantageous manner, the substrate structure underneath the cavity, or the through hole in the substrate delimited by the substrate structure, is designed in such a way that the diaphragm is able to be acted upon by sound pressure on the largest surface possible. It is advantageous in this context if the substrate base is connected to the substrate in the edge region of the cavity via relatively narrow webs. The stability of the substrate structure required for the fixation of the counter element is able to be achieved in an uncomplicated manner in that the substrate base and the webs essentially have the thickness of the unstructured substrate.

In an advantageous development of the example sensor element according to the present invention, the counter element is provided with perforation holes, which reduce damping of the diaphragm oscillation. In addition, a pressure compensation between the cavity above the diaphragm and the environment is able to take place via these perforation holes.

With the aid of the example sensor system according to the present invention, it is possible to detect sound waves in differential manner as well. For this purpose, the example sensor element according to the present invention is simply provided with an additional fixed counter electrode, which is realized in the substrate or in the substrate structure underneath the diaphragm.

BRIEF DESCRIPTION OF THE DRAWINGS

As previously discussed already, there are different possibilities for realizing and further developing the teaching of the present invention in an advantageous manner. In this context, reference is made to the following description of a plurality of exemplary embodiments of the present invention with reference to the figures.

DETAILED DESCRIPTION OF EXAMPLE EMBODIMENTS

Figure 1:
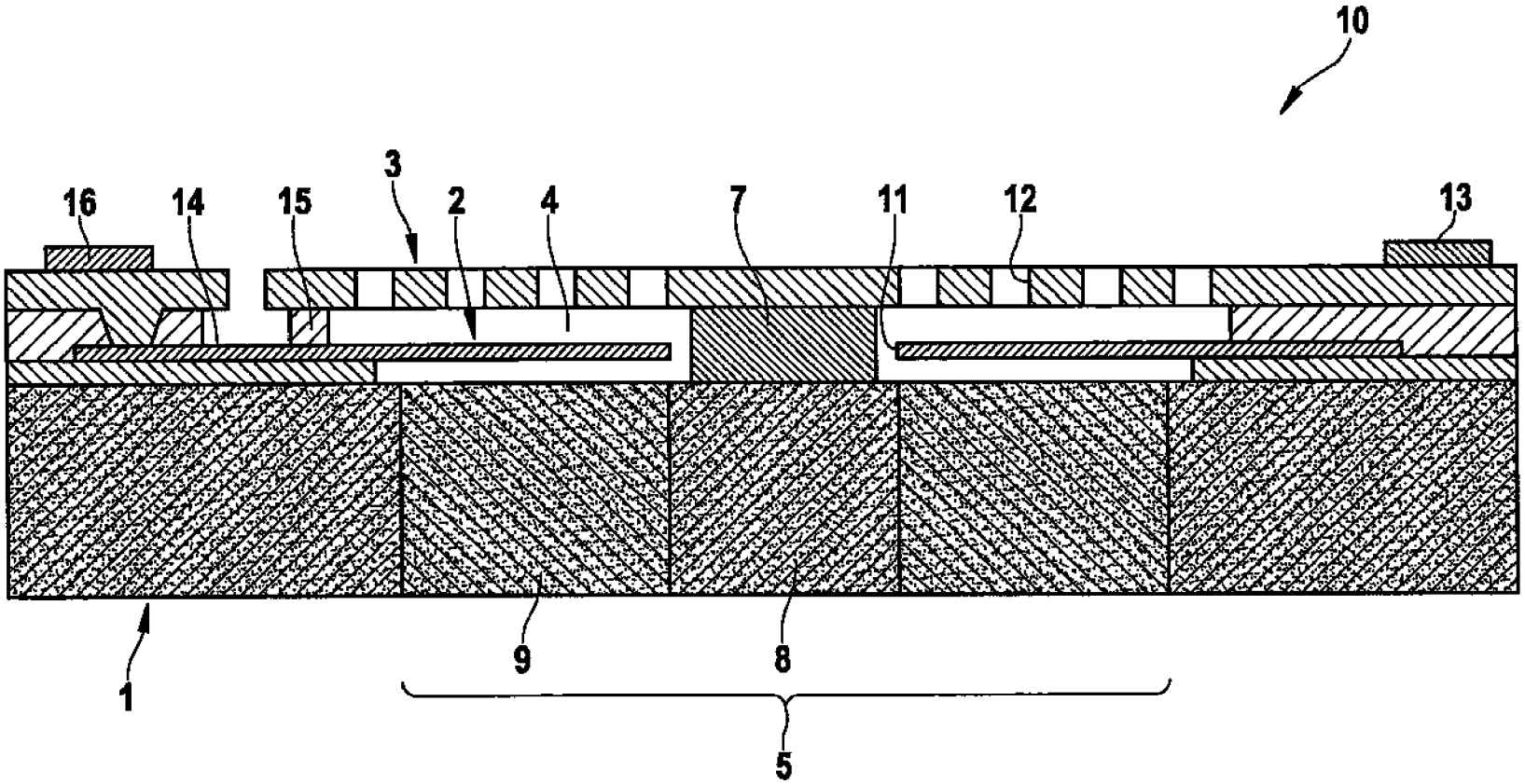
FIG. 1 shows a sectional view through the layer structure of a first example sensor element 10 according to the present invention, in the region of a support point.
Figure 3A:
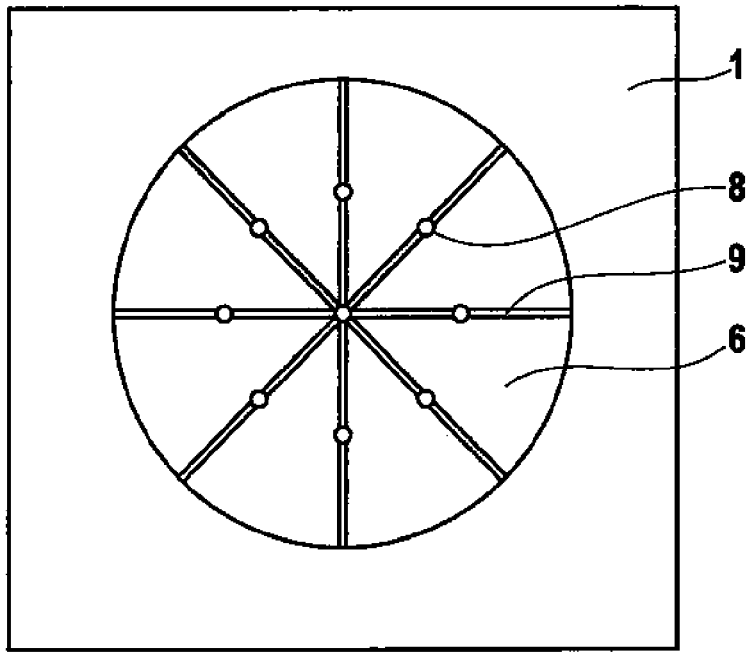
FIG. 3*a* shows a plan view of the substrate of an example sensor element according to the present invention.

The layer structure of acoustic sensor element 10 shown in FIG. 1 includes a substrate 1 above which a diaphragm 2 and a fixed counter element 3 are developed. Diaphragm 2 is situated in a cavity 4 between substrate 1 and counter element 3 and acts as movable electrode of a capacitor system, while counter element 3 forms a fixed counter electrode of this capacitor system. Substrate 1 is structured in region 5 underneath cavity 4. Here there are through-holes for the application of sound waves to diaphragm 2, as illustrated in FIG. 3*a*. Counter element 3 is connected to substrate 1 via a support element 7. Support element 7 is situated in the region of cavity 4 and sits on a substrate base 8, which is part of the substrate structure underneath cavity 4. In addition, this substrate structure includes webs 9, via which substrate base 8 is connected to "substrate mainland" 1 in the edge region of cavity 4. Substrate base 8 as well as webs 9 are realized in the full thickness of substrate 1. Diaphragm 2 has an opening 11 for support element 7, so that diaphragm 2 is able to swing freely inside cavity 4 when corresponding sound pressure is acting on diaphragm 2. Counter element 3 is provided with perforation holes 12 in the region above cavity 4. For the electrical connection of counter element 3, which acts as fixed electrode, a contact connector 13 is provided. Diaphragm 2 acting as movable electrode is routed to a connector pad 16 via a circuit track 14, which runs underneath an electrically insulated diaphragm clamping support 15.

Micromechanical components like the afore-described sensor element 10 are produced on the basis of a semiconductor substrate, e.g., a silicon wafer. Counter element 3, functioning as fixed electrode, of sensor element 10 is developed in a polysilicon layer, for example, with a thickness of 0.5 μm-4 μm. This layer is able to be produced in a simple standard LPCVD process and doped. The layer tension that comes about in such a process typically lies between 10-100 mPa of pressure. Because counter element 3 of sensor element 10 according to the present invention is stabilized and fixed in place with the aid of support element 7, no special measures have to be taken to increase or influence the layer tension. Support element 7 advantageously is made from an electrically insulating material in order to decouple substrate 1 and counter element 3 electrically. For instance, support element 7 may be made of oxide, which is selectively left to remain as residual oxide during the sacrificial layer etching for the purpose of exposing diaphragm 2 and for producing cavity 4. However, other electrically insulated variants are also possible, such as a polysilicon support element having nitride insulation, for instance.

Figure 2:
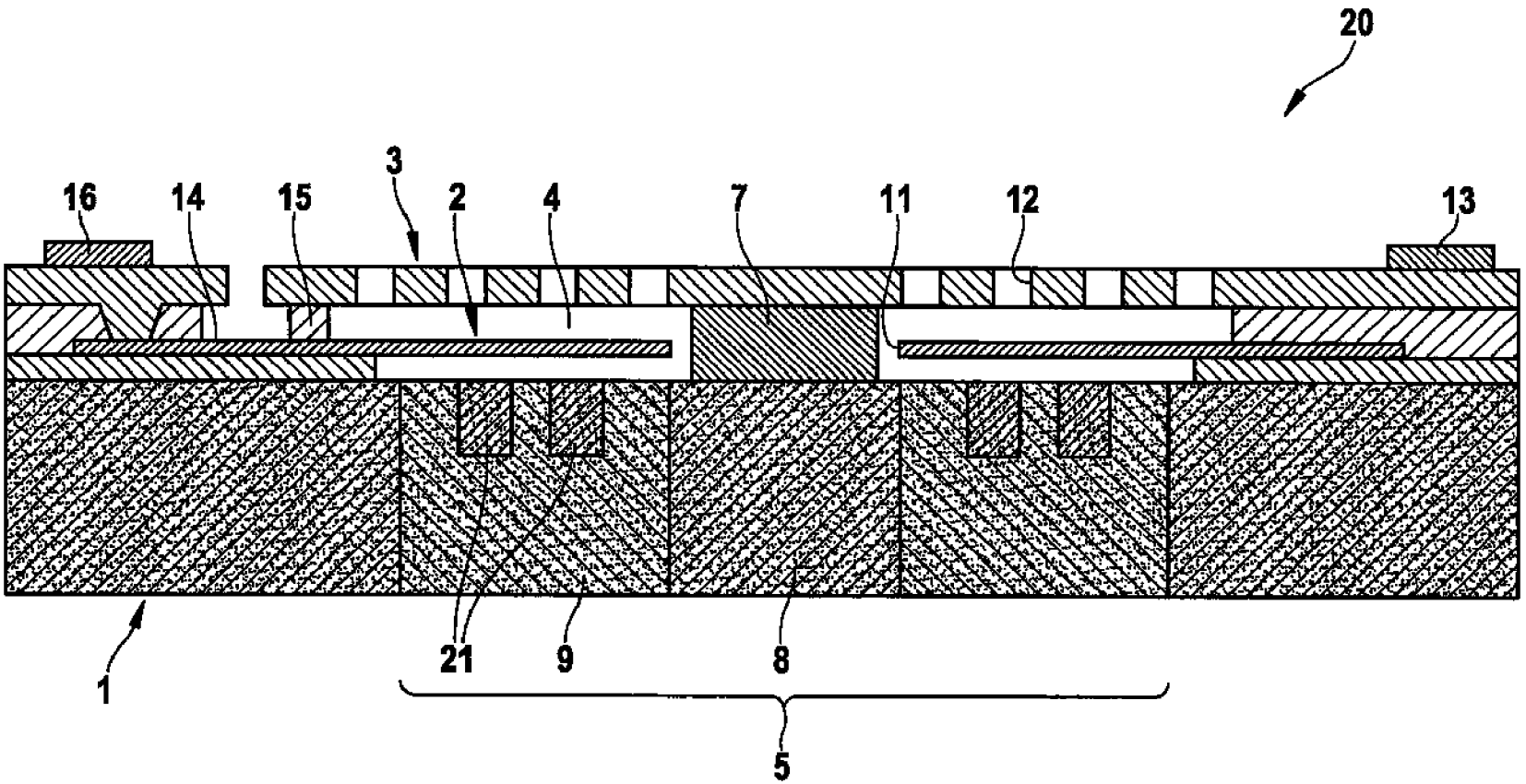
FIG. 2 shows a corresponding sectional view of a second example sensor element 20 according to the present invention.

Sensor element 20 shown in FIG. 2 has the same component structure as sensor element 10 shown in FIG. 1. For this reason, the reference numerals used in FIG. 2 are also the same. However, in contrast to sensor element 10, the capacitor system of sensor element 20 includes additional fixed electrodes 21, which are developed in the region of webs 9 in substrate 1. These fixed electrodes 21 enable a differential detection of the capacitance fluctuations that are created by the movements of diaphragm 2.

The layer structure of a sensor element according to the present invention is explained once more in the following text with the aid of FIGS. 3*a* through 3*c*. The structure elements also shown in FIG. 1 use the same reference numerals.

FIG. 3*a* shows the plan view of substrate 1 in the region of the capacitor system. In this region substrate 1 is provided with through holes 6 for the application of pressure to a diaphragm, which acts as movable electrode and is disposed above substrate 1. Through holes 6 are in the shape of annular segments in this case and separated from each other by eight webs 9 of a corresponding substrate structure. In the center of the substrate structure, at the intersection of the eight webs 9 and in the center of each web 9 between the intersection and the outer circular edge of through holes 6, substrate bases 8 have been formed in the substrate structure. It should be pointed out here that the shape of the through holes is advantageously adapted to the diaphragm shape in order to obtain the best possible sound application of the diaphragm. To achieve excellent fixation of the fixed electrode, substrate bases 8 are distributed as evenly as possible across the wing span of the counter element to be supported.

Figure 3B:
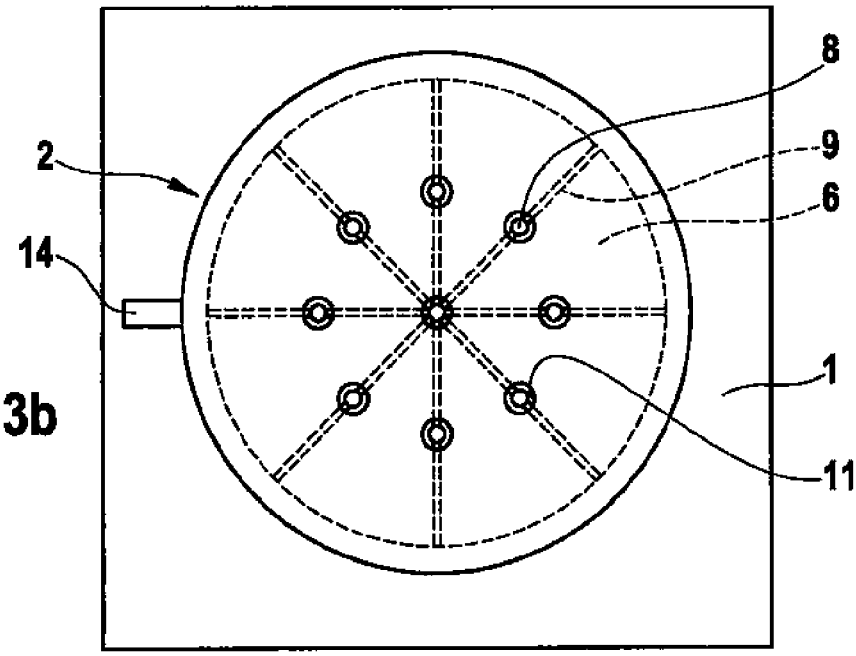
FIG. 3*b* shows a plan view of the diaphragm of this sensor element.

FIG. 3*b* shows substrate 1 after a circular diaphragm 2 has been placed above through holes 6 and the substrate structure delimiting them. As mentioned earlier already, diaphragm 2 functions as movable electrode of the capacitor system of the sensor element. For this purpose, diaphragm 2 is electrically contacted via circuit track 14, which is developed in the same layer as diaphragm 2. Furthermore, FIG. 3*b* makes it clear that diaphragm 2 has been provided with openings 11 in the region above substrate bases 8.

Figure 3C:
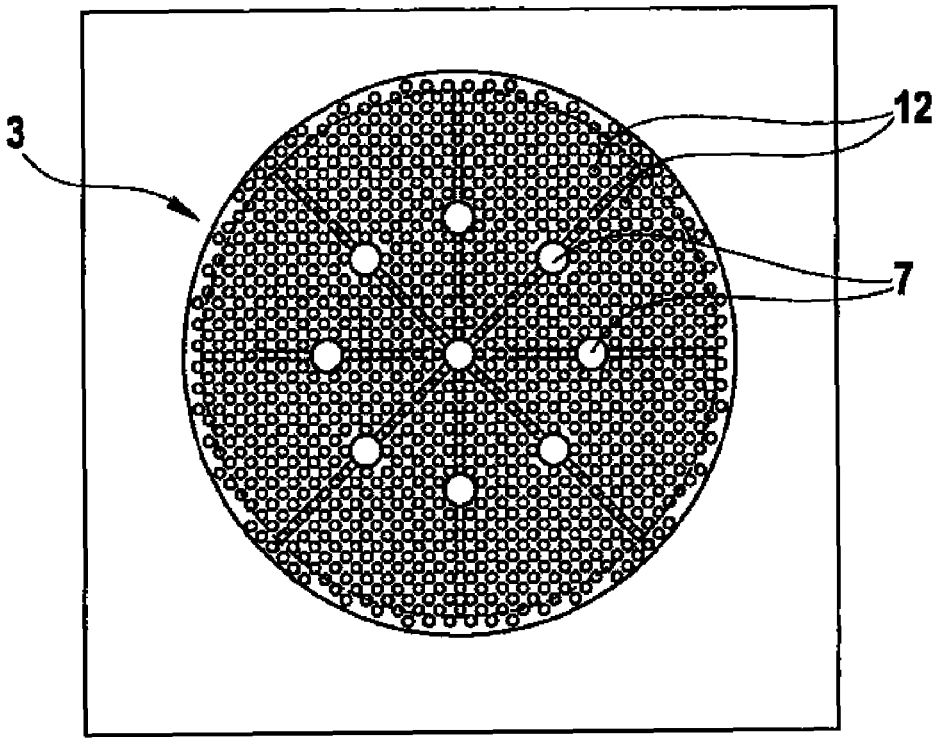
FIG. 3*c* shows a plan view of the counter element of this sensor element.

FIG. 3*c* finally shows a plan view of the layer structure of the sensor element after counter element 3 has been produced above diaphragm 2. Counter element 3 has been provided with perforation holes 12 in substrate 1 in the region above diaphragm 2 and through holes 6. The only region where the structure of counter element 3 is without perforations is in the region above substrate bases 8. In this location there are support elements 7, via which counter element 3 is connected to substrate bases 8. Because of this support construction, the free wing span of counter element 3 is reduced and therefore also the deflection of counter element 3 in response to occurring sound waves.

Figure 4:
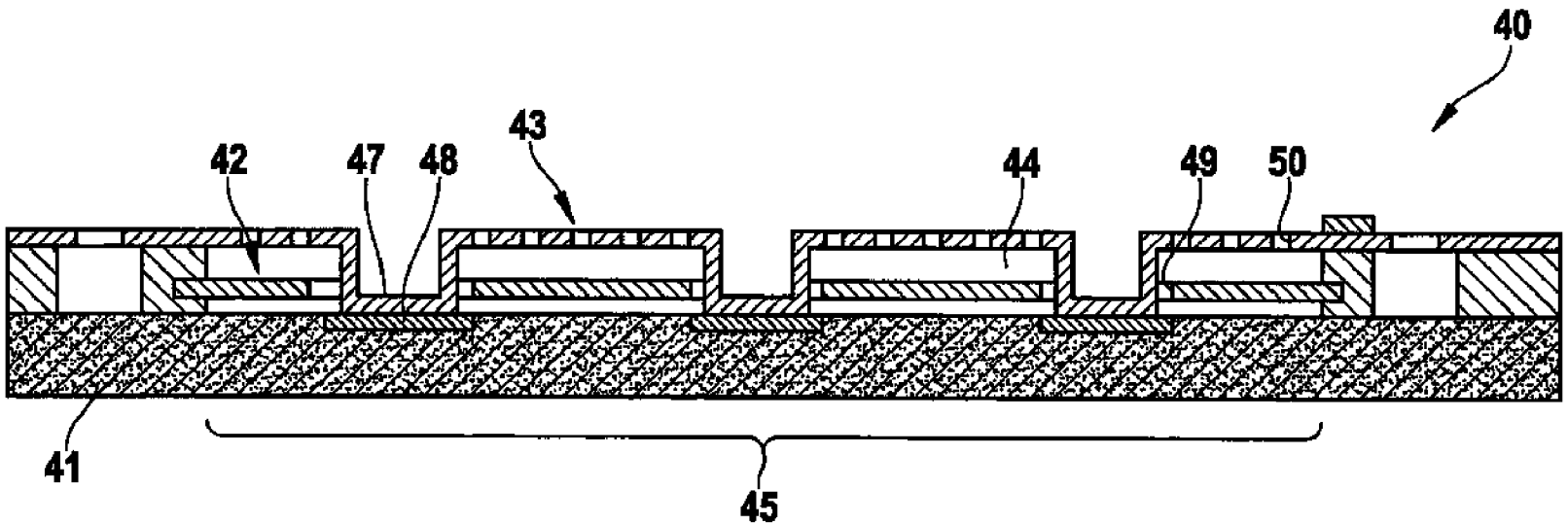
FIG. 4 shows a sectional view through the layer structure of a fourth example sensor element 40 according to the present invention.

FIG. 4 illustrates an acoustic sensor element 40 according to the present invention, which, like in the case of sensor element 10, was produced on the basis of a substrate 41. Formed inside the layer structure above substrate 41 are a diaphragm 42 and a fixed counter element 43. Diaphragm 42 is situated inside a cavity 44 between substrate 41 and counter element 43 and functions as movable electrode of a capacitor system, while counter element 43 forms a fixed counter electrode of this capacitor system. In the region underneath cavity 44 through holes have been formed in substrate 41, via which sound waves are applied to diaphragm 42. These through holes have not been reproduced in the sectional view of FIG. 4 since the sectional plane extends within substrate structure 45, which delimits the through holes.

Sensor elements 10 and 40 generally differ in the realization of support elements 7 or 47 for counter element 3 or 43, respectively. Three infoldings 47 are developed in counter element 43, whose bottom regions are connected to substrate 41 or substrate structure 45 underneath cavity 44 by an insulation layer 48. These infoldings 47 form support elements for counter element 43, which are disposed in the region of cavity 44. Diaphragm 42 has been provided with openings 49 for infoldings 47, so that diaphragm 42 is able to swing freely inside cavity 44 when corresponding sound pressure is acting upon diaphragm 2. Perforation holes 50 are developed in counter element 43 in the region above cavity 44.

What is claimed is:

1. An acoustic sensor element, comprising:

a substrate;

at least one diaphragm; and at least one fixed counter element, the diaphragm being situated in a cavity between the substrate and the counter element and acting as a movable electrode of a capacitor system, the counter element acting as first fixed counter electrode of the capacitor system;

wherein the substrate includes at least one through hole for an application of sound pressure to the diaphragm; and wherein the counter element is connected to the substrate via at least one support element, the support element being situated in a region of the cavity, and the diaphragm has an opening for the support element.

2. The sensor element as recited in claim 1, wherein a substrate structure having at least one substrate base for the at least one support element is formed in a region underneath the cavity.

3. The sensor element as recited in claim 2, wherein the substrate structure includes webs via which the substrate base is connected to the substrate in an edge region of the cavity.

4. The sensor element as recited in claim 2, wherein the substrate base has a thickness of the substrate in an unstructured form.

5. The sensor element as recited in claim 4, wherein the webs have the thickness of the substrate in the unstructured form.

6. The sensor element as recited in claim 1, wherein the counter element has perforation holes.

7. The sensor element as recited in claim 1, wherein at least one additional fixed counter electrode of the capacitor system is in the substrate or in the substrate structure underneath the diaphragm.

* * * * *